United States Patent [19]

Roberts

[11] Patent Number: 4,972,896

[45] Date of Patent: Nov. 27, 1990

[54] STORM WINDOW AND DOOR COVERING APPARATUS

[76] Inventor: Dennis E. Roberts, 317 Young Dr., Sweetwater, Tenn. 37874

[21] Appl. No.: 406,044

[22] Filed: Sep. 11, 1989

[51] Int. Cl.[5] ..... A47H 23/00

[52] U.S. Cl. ..... 160/354; 160/368.1; 24/587; 24/306

[58] Field of Search ..... 160/354, 368.1; 24/587, 24/306

[56] References Cited

U.S. PATENT DOCUMENTS

| | | | |
|---|---|---|---|
| 3,251,399 | 5/1966 | Grossman . | |
| 3,763,917 | 10/1973 | Antinone . | |
| 3,805,872 | 4/1974 | Lorber . | |
| 4,100,957 | 7/1978 | Shelton | 160/368.1 |
| 4,103,728 | 8/1978 | Burdette et al. . | |
| 4,220,298 | 9/1980 | Willis | 160/354 X |
| 4,249,589 | 2/1981 | Loeb . | |
| 4,399,640 | 8/1983 | Porter | 160/368.1 X |

FOREIGN PATENT DOCUMENTS

| | | | |
|---|---|---|---|
| 1092452 | 11/1967 | United Kingdom | 24/587 |

*Primary Examiner*—Blair M. Johnson
*Attorney, Agent, or Firm*—Leon Gilden

[57] ABSTRACT

A covering apparatus is set forth to overlie an existing covered opening such as found in window and door environments. The apparatus includes a continuous elongate strip secured to a window or door frame opening with a companion strip receivable therein integrally secured and formed as a perimeter of a flexible transparent covering membrane for the window or door opening.

1 Claim, 6 Drawing Sheets

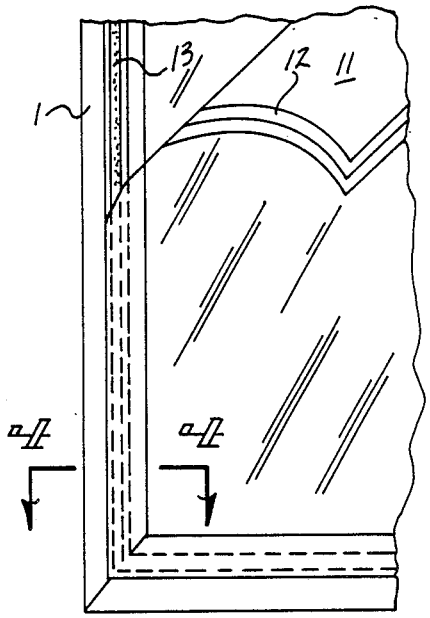
FIG 3
FIG 4
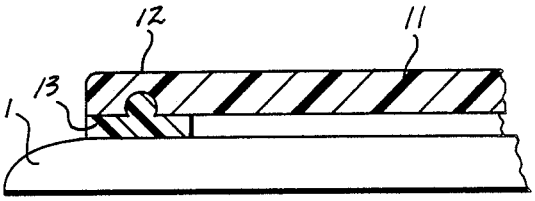

STORM WINDOW AND DOOR COVERING APPARATUS

BACKGROUND OF THE INVENTION

1. Field of the Invention

The field of invention relates to storm window and door coverings, and more particular pertains to a new and improved storm window and door covering apparatus wherein the same utilizes a selectively securable flexible membrane to overlie a window or storm door opening securable to a companion strip adhered to the frame of the window or door opening.

2. Description of the Prior Art

Window and door coverings are utilized in the prior art to overlie existing window and storm doors to enhance a thermally insulative effect in an effort to minimize heat loss therethrough, particularly in wintry scenarios. The prior art has heretofore utilized various manners of securement of the coverings, but has heretofore failed to provide the details as set forth by the instant invention to provide a covering of enhanced thermally insulative securement of the edge to edge relationship of the transparent covering relative to the window or door framework. Examples of the prior art include U.S. Pat. No. 4,103,728 to Burdette, et al., wherein a circular elongate cylindrical bead is positioned within a channel defined by a generally square configuration to secure the bead therewithin.

U.S. Pat. No. 3,805,872 to Lorber sets forth a magnetic means for attaching a screen to overlie an associated door or window framework.

U.S. Pat. No. 3,763,917 to Antinone sets forth a screen securable to a framework utilizing separate fastening means to effect the association. As may be appreciated, the attachment of screens to frameworks by its inherent nature does not concern itself with the thermal insulative property of the screens and accordingly, the attaching of screens to a framework need not include thermally insulative edge binding as set forth by the instant invention.

U.S. Pat. No. 3,251,399 to Grossman sets forth a window covering to overlie a screen utilizing hook and loop fastening elements, wherein the covering includes a zippered flap to enable selective opening of the window without disassociation of the hook and loop fastener securement portions.

U.S. Pat. No. 4,249,589 to Loeb sets forth a screen of sheeting covering to overlie a window utilizing hook and loop materials to effect the association.

As such, it may be appreciated that there is a continuing need for a new and improved storm window and door covering apparatus which addresses both the problems of effectiveness in sealing of the covering relative to the framework of the window or door opening, as well as ease of use of the organization, and in this respect, the present invention substantially fulfills this need.

SUMMARY OF THE INVENTION

In view of the foregoing disadvantages inherent in the known types of storm and window door coverings now present in the prior art, the present invention provides a storm window and door covering apparatus wherein the same utilizes enhanced securement means to secure a flexible membrane to overlie a window or door opening for enhanced insulative covering of the window or door opening. As such, the general purpose of the present invention, which will be described subsequently in greater detail, is to provide a new and improved storm window and door covering apparatus which has all the advantages of the prior art storm window and door coverings and none of the disadvantages.

To attain this, the present invention includes a central transparent membrane secured to a window or door framework. The covering includes a first securement means defined as an elongate channel receiving a single protuberance therein. Alternatively, a plurality of diamond shaped protuberances are receivable within a plurality of similarly configured channels. An enhanced securement of the edge to edge relationship of the membrane to the framework includes a sealing member including a channel positioned within a protuberance that is itself received within a protuberance and a channel of like configuration to effect sealing and securement of the membrane to the associated window or door framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved storm window and door covering apparatus which has all the advantages of the prior art storm window and door coverings and none of the disadvantages.

It is another object of the present invention to provide a new and improved storm window and door covering apparatus which may be easily and efficiently manufactured and marketed.

It is a further object of the present invention to provide a new and improved storm window and door covering apparatus which is of a durable and reliable construction.

An even further object of the present invention is to provide a new and improved storm window and door covering apparatus which is susceptible of a low cost of manufacture with regard to both materials and labor, and wich accordingly is then susceptible of low prices of sale to the consuming public, thereby making such storm window and door cover apparatus economically available to the buying public.

Still yet another object of the present invention is to provide a new and improved storm window and door covering apparatus which provides in the apparatuses and methods of the prior art some of the advantages thereof, while simultaneously overcoming some of the disadvantages normally associated therewith.

Still another object of the present invention is to provide a new and improved storm window and door covering apparatus wherein the same provides enhanced sealing of an edge to edge relationship of a covering membrane overlying a window or door framework.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, somewhat enlarged, of the securement of the covering membrane relative to a window or door framework.

FIG. 4 is an orthographic view taken along the lines 4—4 of FIG. 3 in the direction indicated by the arrows.

FIG. 13 is an orthographic cross-sectional view, somewhat enlarged, of the structure as illustrated in FIGS. 11 and 12 in association with a door or window framework.

DESCRIPTION OF THE PREFERRED EMBODIMENT

Figure 1:
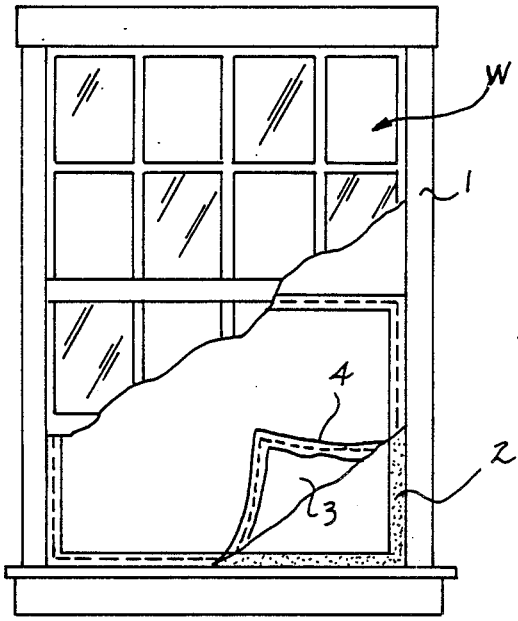
FIG 1 PRIOR ART
FIG. 1 is an orthographic view taken in elevation of the prior art.

With reference now to the drawings, and in particular to FIGS. 1 to 13 thereof, a new and improved storm window and door covering apparatus embodying the principles and concepts of the present invention and generally designated by the reference numeral 10 will be described.

More specifically, the storm window and door covering apparatus 10 provides an improvement of the prior art, as illustrated in FIG. 1, wherein a transparent flexible membrane 3 formed with a reinforcing securement edge 4 is adhered to an adhesive strip 2 about an associated window frame 1 to overlie a window "W". Accordingly, the window "W" may be substituted by a door, as desired.

Figure 2:
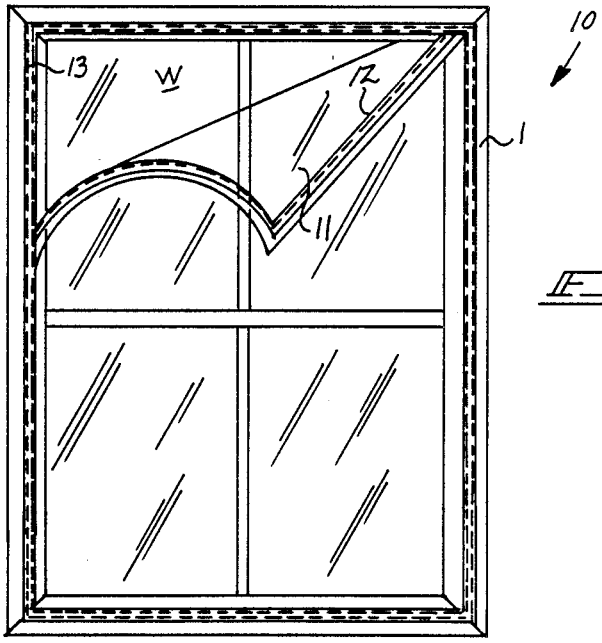
FIG. 2 is an orthographic view taken in elevation of the instant invention.
Figure 5:
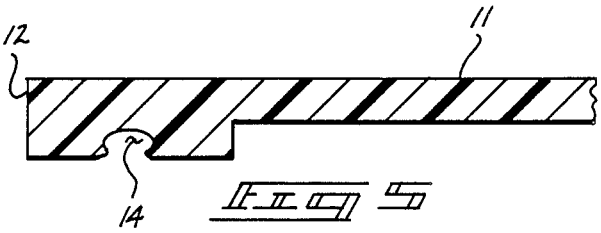
FIG. 5 is an enlarged cross-sectional view of the covering membrane securement strip.
Figure 6:
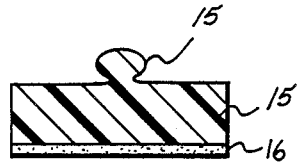
FIG. 6 is an orthographic view taken in elevation of the window or door framework connecting strip.
Figure 7:
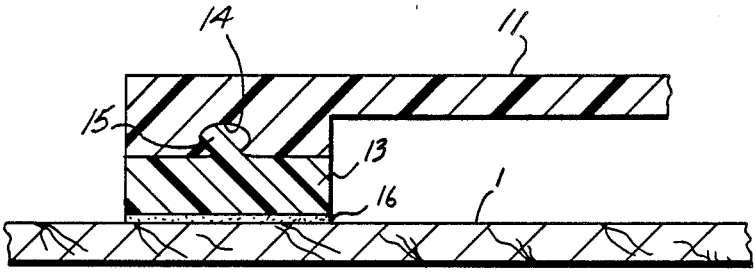
FIG. 7 is an orthographic view taken in elevation of the membrane secured to the framework and the relative association therewith.

FIG. 2 is illustrative of the instant invention wherein the window "W" is provided with a transparent membrane 11 that is formed with a membrane first securement strip 12 for association with a second securement strip 13 of the associated window frame 1. As illustrated in FIG. 4, the first securement strip 12 is formed as a channel of an ellipsoidal cross-sectional configuration 14 to receive a securement projection 15 of a complementary ellipsoidal cross-sectional configuration receivable within the channel 14. An adhesive strip 16 is formed to a bottom surface of the second securement strip for adhesive association with the window frame 1, as illustrated in FIG. 7 for example. The bottom surface **12*a* of the first securement strip and the top surface 13*a* of the second securement strip 13** are of an equal length to minimize overlap, and wherein both surfaces are planar to effect a weather-tight seal minimizing thermal transfer therethrough.

Figure 8:
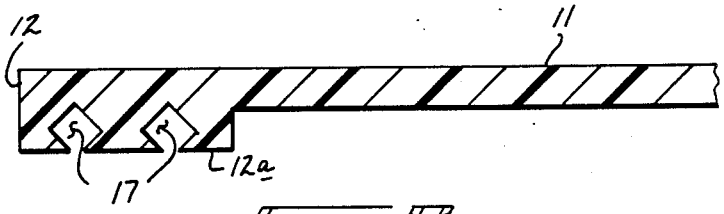
FIG. 8 is an orthographic view taken in elevation of a modified securement replaceable membrane fastening strip.
Figure 9:
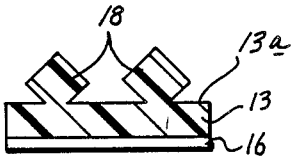
FIG. 9 is an orthographic cross-sectional view of a modified securement fastening strip in association with a door or window framework.
Figure 10:
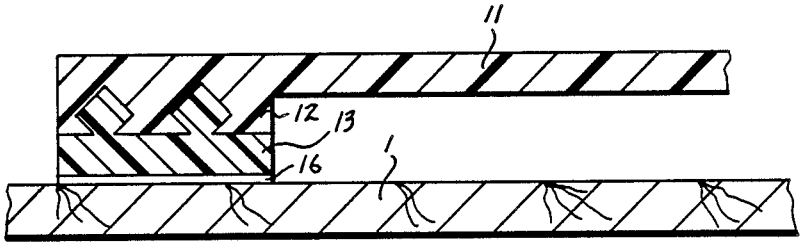
FIG. 10 is an orthographic cross-sectional view, somewhat enlarged, of the membrane and fastening strip and the securement fastening strip in association with a door or window framework.

FIG. 8 illustrates a modified first securement strip 12 formed with a plurality of securement channels 17 therewithin of a diamond cross-sectional configuration for receiving plural securement projections 18 integrally formed to the second securement strip 13 of an equal diamond shaped configuration receivable within the channels 17. The plural interlocking arrangement ensures an improved barrier against thermal flow therethrough, and further resists dislodging of the projections relative to the channels, as may occur when the flexible transparent membrane 11 is subjected to drafts, impact, and the like.

Figure 11:
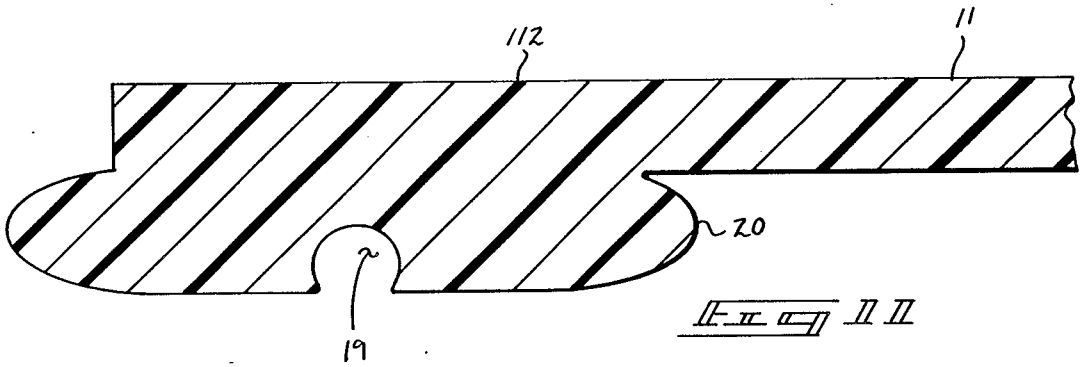
FIG. 11 is an enlarged cross-sectional view of a further modified fastening strip utilized by a transparent membrane to overlie a storm window or door opening.
Figure 12:
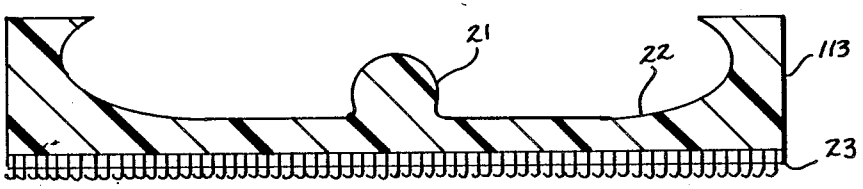
FIG. 12 is an orthographic cross-sectional view, somewhat enlarged, of a fastening member for association with a storm window or door framework.
Figure 11:
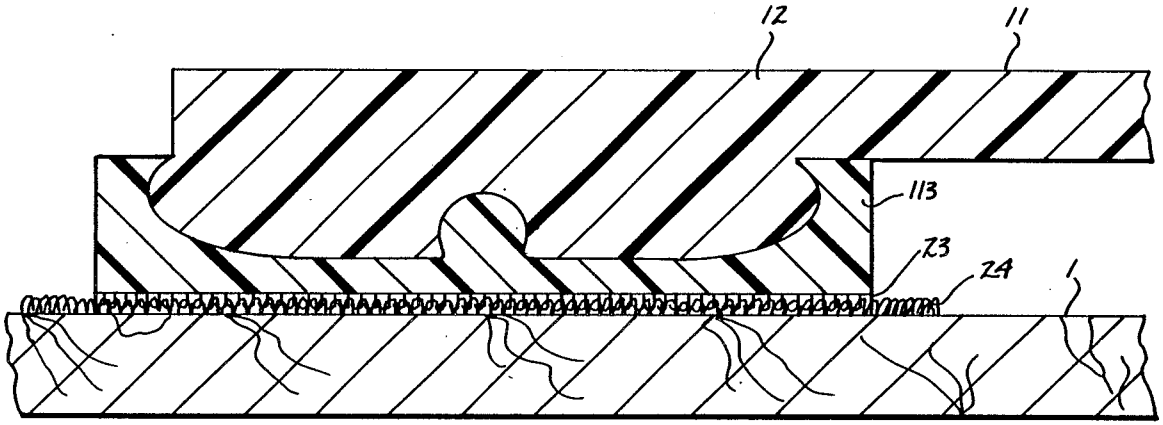

FIGS. 11–13 illustrate a modified first securement strip 112 for interlocking association with an improved second securement strip 113. The first securement strip is formed with a truncated cylindrical channel 19 positioned medially of a projecting ellipsoidal projection 20 formed at the perimeter of the membrane 11 as the first securement strip 112. The cylindrical channel 19 receives a truncated cylindrical projection 21 formed medially within an ellipsoidal groove 22 at the floor thereof, as illustrated in FIG. 12. The projection 21 is received within the groove 19, while similarly the projection 20 is received within the similarly configured ellipsoidal channel 22. Hook and loop fasteners 23 may be utilized in association with further hook and loop fasteners 24 formed to the window frame 1 to enable securement of the second securement strip 113 thereto. It should be noted that the inherent flexibility of the first and second securement strips enable the interlocking engagement of the projections in association with the channels of opposing strips.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for mounting a thin, flexible membrane over a window or door opening defined by a peripherally disposed perimeter framework mounted in a plane, the apparatus comprising, a membrane including a fastener strip integrally formed to an underlying perimeter surface of the membrane, and a continuous elongate securement strip including an underlying securement surface for securement to the frame, the fastener strip and securement strip each formed of a flexible material to accommodate selective interlocking and subsequent disengagement between the fastener strip and securement strip, and wherein the fastener strip includes a truncated ellipsoidal projection, and a bottom surface of the truncated ellipsoidal projection includes a truncated cylindrical channel formed medially therein, and the securement strip includes securement top surface formed with a truncated ellipsoidal channel of a complementary configuration to the ellipsoidal projection, and the ellipsoidal channel further includes a truncated cylindrical projection positioned medially thereof and directed upwardly of a bottom surface of the channel, the truncated cylindrical projection being defined by a first cross-sectional configuration equal to a like first cross-sectional configuration defined by the truncated cylindrical channel formed within the fastener strip, and a bottom surface of the securement strip including first hook and loop fasteners for securement to second hook and loop fasteners secured to the frame.

* * * * *